United States Patent [19]

Rote

[11] 3,998,664

[45] Dec. 21, 1976

[54] CAST IRON

[76] Inventor: Franklin B. Rote, 5902 Rickfield South, Jackson, Mich. 49203

[22] Filed: Mar. 31, 1975

[21] Appl. No.: 563,616

Related U.S. Application Data

[63] Continuation-in-part of Ser. No. 378,827, July 13, 1973, abandoned.

[52] U.S. Cl. ..... 148/3; 75/123 CB; 148/35; 148/138; 148/139; 148/140; 148/141

[51] Int. Cl.[2] ..... B22D 25/06

[58] Field of Search ..... 75/123 CB; 148/35, 138, 148/139, 140, 141, 3

[56] References Cited

UNITED STATES PATENTS

| | | | |
|---|---|---|---|
| 1,542,440 | 6/1925 | Drysdale | 75/123 CB |
| 2,791,526 | 5/1957 | Peras | 75/123 CB |
| 2,887,421 | 5/1959 | Peras | 148/35 |
| 3,000,770 | 9/1961 | Wittmoser | 148/35 |
| 3,384,515 | 5/1968 | Ackerman et al. | 148/35 |

OTHER PUBLICATIONS

Physical and Engineering Properties of Cast Iron, Angus, 1960, British Cast Iron Research Assoc., London, pp. 424–428.

*Primary Examiner*—W. Stallard
*Attorney, Agent, or Firm*—Barnes, Kisselle, Raisch & Choate

[57] ABSTRACT

A heat treated cast iron wherein the carbon and silicon contents are controlled to produce a white iron as cast in a sand mold and the sulfur content is in excess of that required to combine with all the manganese in the iron. The iron is annealed to produce temper carbon and a ferrous matrix containing a uniform distribution of iron sulfide particles of finite size.

10 Claims, 4 Drawing Figures

CAST IRON

Figure 1:
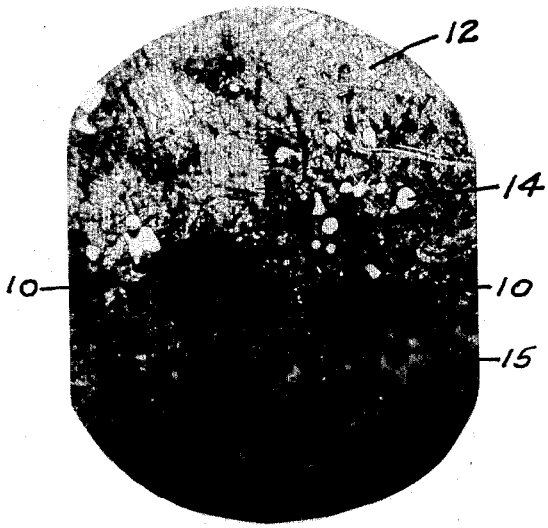

This application is a continuation-in-part of applicant's prior application Ser. No. 378,827, filed July 13, 1973, and now abandoned.

This invention relates to iron castings and, more particularly, to heat treated iron castings having superior wear and abrasion resistant properties.

Many cast iron parts are subjected to a relatively high degree of wear and abrasion in use. This is particularly true of camshafts and tappets in internal combustion engines which are subjected not only to severe wear conditions but which also operate under high surface loading at high speeds. Heretofore such shafts have been manufactured either as low or medium carbon steel forgings, alloyed gray iron castings, or nodular iron castings. In each cast the lobe or wear surface of the cams or tappets are suitably hardened. However, regardless of which of the above forms such parts are made in, as heretofore manufactured they do not possess the optimum wear and abrasion resistant properties desired of such parts by reason of the severe use to which they are put.

The present invention has for its primary object the provision of a heat treated cast iron possessing excellent wear and abrasion resistant properties as compared with forgings and other iron castings. Cast irons of the present invention are admirably suited for use as camshafts, tappets and other castable parts which, in use, are subjected to severe wear and abrasion conditions.

More specifically, the present invention contemplates cast iron having a microstructure consisting generally of rounded graphite, a ferrous matrix and a uniform distribution of hard, essentially iron sulfide particles of finite size in the matrix which reinforces the same. It should be noted that reference to the particles as "essentially iron sulfide" implies that the major elements are iron and sulfur, but that other elements, such as silicon, manganese, nickel, copper, molybdenum and others which normally occur in cast ferrous metals, may also be present in minor amounts within the essentially iron sulfide particles. Such co-occurrence is a natural phenomenon. Depending upon the composition and the heat treatment to which the iron is subjected, the microstructure may also include particles of iron sulfide-iron carbide complex which are relatively large in comparison to the iron sulfide particles. The iron of the present invention as cast has a substantially white fracture and the graphite in the heat treated iron results from annealing the white iron. Accordingly, the graphite appears in the microstructure generally in the desirable form of temper carbon. The critical microconstituent of the iron is the fine, generally uniform distribution of the essentially iron sulfide particles. According to the present invention it is essential that the iron sulfide particles be sufficiently large as to be visible at 100 magnifications. Unless the particles are of at least this size no appreciable improvement over conventional irons will be obtained. This microconstituent is obtained upon annealing of a sand cast white iron as a result of a sulfur content in excess of that required to combine with the manganese present in the iron. The quantity of free iron sulfide in the iron may be varied, according to the requirements of the engineering application, by control of the sulfur content of the iron in relation to the manganese content and by the heat treatment of the iron.

In any ferrous composition sulfur combines with manganese to produce manganese sulfide until substantially all the manganese or all of the sulfur has been combined. A high sulfur content in iron is normally considered to be detrimental to such mechanical properties as tensile and yield strength, elongation and impact toughness. Accordingly, a maximum sulfur content is usually specified in cast iron compositions. Furthermore, in view of the adverse effects on the mentioned physical properties the maximum amount of sulfur called for in cast iron compositions is invariably less than that amount which is required to combine with all the manganese. Stated differently, specifications for cast iron invariably call for a sulfur content which is substantially less than 58.3% of the manganese content by weight. The ratio of sulfur to manganese in manganese sulfide is 0.583 part sulfur to 1.0 part manganese by weight. The excess manganese insures that all the sulfur in conventional irons will be in the form of manganese-sulfide or other sulfides which are relatively soft in comparison to iron sulfide and that some free manganese is present in the iron.

From the standpoint of composition the present invention is characterized by the fact that the carbon, silicon and sulfur contents are balanced to produce a white fracture in a sand casting and the sulfur content of the iron is adjusted to combine with all the manganese in the iron (namely, 58.2% of the manganese content by weight) plus from about 0.02 to 0.40% sulfur. As distinguished from chill casting, the relatively slow rate of cooling in a sand mold is required in the present invention to obtain a coarse solidification structure which is in turn necessary to produce iron sulfide particles of finite size during annealing. The excess sulfur in the composition, upon suitable annealing, forms free iron sulfide. Within the stated range of excess sulfur varying amounts of iron sulfide are present in the microstructure. The lower levels satisfy moderate wear conditions and the high levels of free iron sulfide meet the requirements of severe wear conditions.

In the as-cast condition of the iron the sulfur appears in large particles of iron sulfide-iron carbide complex. Upon annealing the iron sulfide-iron carbide complex breaks down, either partially or completely depending on composition and selected annealing heat treatment, to produce graphite in the form of temper carbon and a relatively uniform distribution of essentially iron sulfide particles clearly visible at 100 magnifications. While these particles undoubtedly contain some carbide and possibly contain very small amounts of other alloying elements, such as silicon, nickel, molybdenum, copper, chromium, etc., nevertheless the particles which form the relatively uniform distribution throughout the matrix consist essentially of iron sulfide. The hardness of these particles as measured on a microhardness tester is about 65 Rockwell "C". Where the composition of the iron and its heat treatment is controlled to produce residual iron sulfide-iron carbide complex in the microstructure, the hardness of the iron sulfide-iron carbide phase as measured on a microhardness tester is about 67 Rockwell C. A distribution of such hard particles of finite size throughout the iron obviously imparts superior wear and abrasion resistance qualities to the iron. These properties of the iron are enhanced by the fact that the graphite is in the rounded, temper carbon form which serves as pockets for any lubricant which may be applied to the wear surface.

Another important feature of cast irons according to the present invention resides in the fact that the hard particles which consist of the freed iron sulfide and any residual iron sulfide-iron carbide complex are widely dispersed throughout the matrix and are of a rounded character. In castings containing only a small amount of residual complex the iron sulfide particles occur throughout the matrix, thus reinforcing the matrix microconstituent. In those castings which contain a considerable amount of residual complex the substantially larger particles of the complex form a hard base surrounded by the softer matrix constituent containing the iron sulfide particles. In either case, the hard particles of generally rounded form provide excellent wear and abrasion resistance without being excessively abrasive to a mating surface. Other materials where the hard particles have a sharply angular shape are, accordingly, very abrasive to other mating surfaces and, thus, produce undesirable wear.

The basic composition of the iron of the present invention can be considered as the following:

Total Carbon — 2.50 to 3.10%
Silicon — 1.40 to 2.00%
Manganese — Not Specified
Sulfur — 0.583 × % manganese + 0.02 to 0.40%

Irons of this composition range will, after partial or complete annealing, possess good hardenability, equal to pearlitic malleable or gray cast iron. Where higher hardenability is required, small amounts (generally less than 1%) of alloying elements, such as nickel, molybdenum, or copper, may be added. The carbon equivalent (%C+1/3%Si) of the present iron is greater than that of a conventional malleable iron. The higher carbon equivalent can be tolerated and still produce a white fracture as cast because of the higher sulfur content. The sulfur in the composition in excess of that required to combine with the manganese is functionally very desirable. It acts as a carbide stabilizer to retard graphitization during solidification. It retards the decomposition of the iron sulfide-iron carbide complex during annealing and, most important, it provides a uniform distribution of essentially iron sulfide particles in the matrix.

In order to satisfy the requirements of a coarse as-cast structure, casting in sand molds is required. In order to produce a white iron fracture in sand molds, the carbon equivalent must be carefully balanced with section size and sulfur content. According to the present invention, the carbon equivalent should be between 3.0 and 3.60%. With a free sulfur content below 0.05% carbon equivalent should be 3.0 to 3.30%. With increasing free sulfur content to a maximum of 0.40% the upper limit of carbon equivalent may increase progressively to a maximum of 3.60%. For example, an iron with 0.02% free sulfur should have a carbon equivalent of 3.0 to 3.30%. Another iron with 0.40% free sulfur can, because of the carbide stabilizing effect of sulfur, tolerate a carbon equivalent up to 3.60% and would be produced with a carbon equivalent of 3.0 to 3.60%.

As indicated in the composition set forth above, the important elements are carbon, silicon and sulfur. The carbon and silicon contents are balanced with the sulfur content within the ranges specified, depending upon the size of the casting, so as to permit the metal to solidify substantially white (free of graphite) upon initial casting in a sand mold. As indicated, the sulfur content is adjusted to that amount which will combine with all the manganese inherent in the metal to form manganese sulfide plus about 0.02 to 0.4%. The manganese content of the iron is not set forth specifically because of the wide range of manganese which exists in the available charge materials; namely, scrap iron, pig iron, etc. Furthermore, since all the manganese in the iron is combined to form manganese sulfide which solidifies as discrete particles before the base iron begins to solidify and since the manganese sulfide plays no important part in the subsequent metallurgy, most any range of manganese from substantially none to over 1% can be tolerated in the iron of this invention.

In production the iron is melted by any conventional method, such as cupola, cupola-secondary furnace duplexing, or electric furnace. It is cast in conventional molds; that is, dry sand, shell or green sand. Preferably the molds should be of the type which will not produce large amounts of gas, particularly from hydrocarbons or water vapor, to prevent pinholing of the castings. After casting, the iron is heat treated in a variety of ways to develop the specific wear and abrasion resistant properties desired.

The as-cast mircrostructure is similar to that of a so-called white iron which, unless highly alloyed, consists of primary cementite (iron carbide) and pearlite (iron carbide and ferrite). The iron of this invention as cast differs from conventional white iron however in that it contains an additional important phase; namely, iron sulfide. In the as-cast condition the iron sulfide appears in the iron sulfide-iron carbide complex. While the as-cast structure possesses wear and abrasion resistance and could be used in certain specialized operations, (such as grinding balls or mill liners), the most important and desired properties of the iron are developed after heat treatment.

The heat treatment of the iron castings begins with an annealing operation which breaks down some or all of the primary cementite to graphite and austenite, depending upon the engineering application. Annealing preferably consists of heating the casting from about 2 to 20 hours at 1650°–1850° F. During annealing there is a breakdown of the coarse iron sulfide-iron carbide phase which frees iron sulfide that remains as particles of finite size in the austenite. A short annealing time or a low annealing temperature favors the retention of substantial amounts of free iron carbide while a long time at high temperatures favors a complete breakdown of the primary iron carbide into a form of temper carbon graphite and austenite. Depending upon the intended application of the casting, the annealing is controlled to retain a substantial amount of iron carbide or to decompose all the iron carbide.

After annealing the iron may be cooled in the annealing furnace to a temperature of about 1500°–1600° F. This controlled cooling permits some of the carbon in the austenite to migrate and deposit on existing graphite particles. When the iron has been slowly cooled to about 1500°–1600° F. the resultant matrix austenite carbon content (combined carbon) is then at a level which will permit oil quenching without cracking. However, if desired, after cooling to about 1500°–1600° F. the iron can be cooled to room temperature in air. Air cooling produces a matrix of pearlite with rounded graphite, iron sulfide and varying amounts of free cementite (depending upon the time and temperature employed in the high temperature annealing as indicated above). On the other hand oil quenching from about 1500°–1600° F produces a martensitic matrix with the same embedded constituents. The oil quenching structure is the hardest and most wear resistant. However, it is brittle and not entirely satisfactory for certain mechanical applications. The martensitic structure may be used in service with no further heat treatment or it may be stress relieved or tempered, depending on the requirements of the engineering application. Time and temperature of the stress relieving or tempering operations are selected to satisfy specific requirements. Where the martensitic structure is not suitable for the intended use the iron may be cooled to room temperature in air to produce a pearlitic matrix and then given a surface heat treatment, such as flame or induction hardening, which provides a hard wear resistant outer surface and a tough interior. Surface hardening after air cooling is accomplished by flame or induction heating to about 1500°–1600° F. followed by oil quenching. This will produce a tough pearlitic matrix on the interior and a martensitic matrix on the surface.

To better illustrate the microstructure obtainable with various compositions of the present invention attention is directed to FIGS. 1 through 4.

FIG. 1 shows the microstructure at about 500 magnifications of an iron having the following composition:

Total Carbon — 2.84%
Silicon — 1.82%
Manganese — 0.28%
Sulfur — 0.25%

In this composition the sulfur in excess of that which combined with the manganese amounts to about 0.085%. The as-cast structure was white iron. The iron was annealed for 8 hours at 1700° F., furnace cooled to 1600° F., and then air cooled to room temperature. Thereafter it was heated in an oxygen-natural gas flame for 60 seconds at 1600° F. and oil quenched. The resultant microstructure consists of graphite in the form of generally rounded, temper carbon particles 10, a martensitic matrix 12, a generally uniform distribution of small particles of iron sulfide designated 14 and a small amount of larger particles of residual iron carbide-iron sulfide complex 15.

Figure 2:
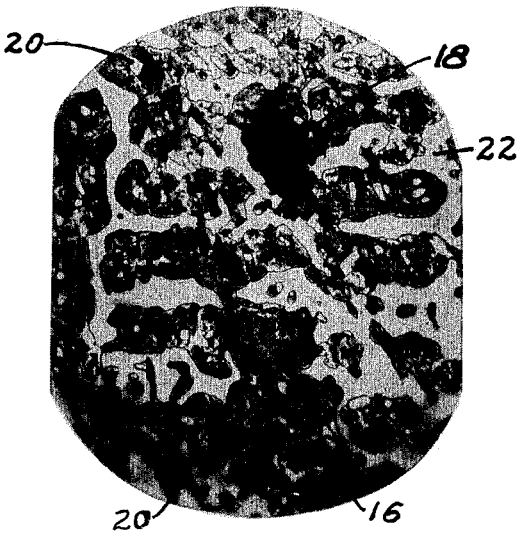

FIG. 2 shows the microstructure at 500 magnifications of an iron having the following composition:

Total carbon — 2.74%
Silicon — 1.59%
Manganese — 0.52%
Sulfur — 0.52%

The functional free sulfur, after combination with the manganese, amounted to 0.22%. The as-cast structure was free of primary graphite. The iron was annealed for 6 hours at 1750° F., cooled in a furnace to 1600° F., and then air cooled to room temperature. As indicated in FIG. 2, the resultant microstructure consisted of a pearlitic matrix 16, particles of temper carbon 18, a uniform distribution of small iron sulfide particles 20 and larger particles of iron sulfide-iron carbide complex 22.

Figure 3:
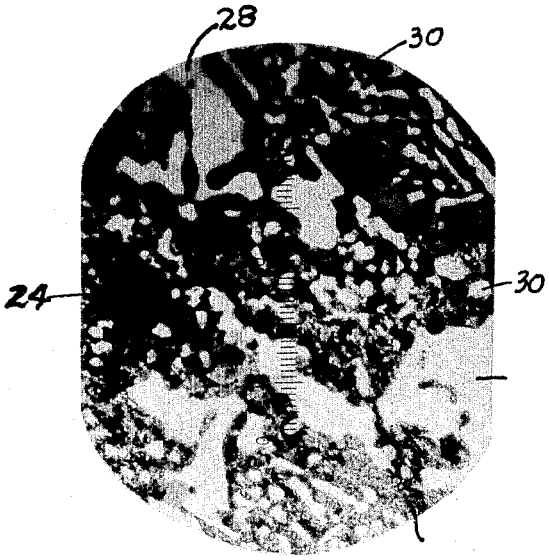

FIG. 3 illustrates the microstructure of iron at 500 magnifications having the following composition:

Total Carbon — 2.68%
Silicon — 1.64%
Manganese — 0.23%
Sulfur — 0.48%

The functional free sulfur after combination with the manganese amounted to 0.345%. The structure of the iron was white as cast. The iron was annealed for 10 hours at 1750° F., furnace cooled to 1600° F., and then air cooled to room temperature. As shown in FIG. 2, the microstructure consists of temper carbon 24, a pearlitic matrix 26, some residual primary iron sulfide-iron carbide complex particles 28, and a distribution of secondary iron sulfide particles 30 in the pearlitic matrix. Flame hardening of this casting developed a hardness of 63–64 Rockwell C. The presence of residual primary iron sulfide-iron carbide complex renders this iron admirably suited for castings subjected to extremely severe abrasion and wear conditions.

Figure 4:
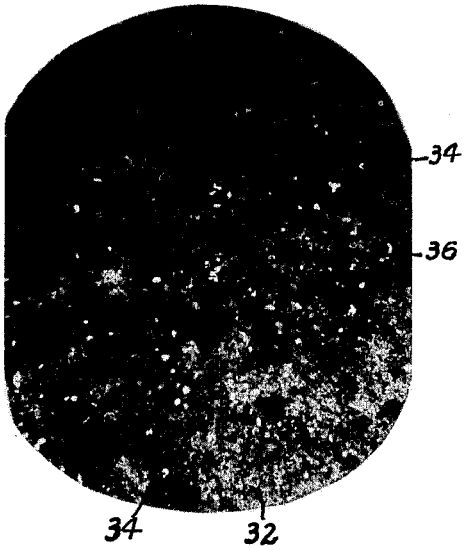

FIG. 4 illustrates at 100 magnifications the same iron shown in FIG. 1. As a result of a 2% nital etch the martensitic matrix 32 appears as a dark pattern and presents a strong contrast with the iron sulfide particles 34. The fact that FIG. 4 shows the microstructure at 100 magnifications rather than about 500 magnifications (as is the case in FIGS. 1 through 3) better illustrates the uniform distribution of the iron sulfide particles throughout the matrix and also the precipitation of the graphite from the austenite into the round, temper carbon form as indicated at 36.

Thus, it will be seen that the present invention provides as cast iron admirably suited for use involving severe abrasion and wear conditions. Tests have shown that heat treated camshafts of the present invention containing the above-mentioned excess sulfur have a service life of 3 to 4 times that of conventional camshafts. Obviously the invention is not limited to camshafts and tappets. The iron compositions disclosed herein are admirably suited for numerous parts which are subjected to severe abrasion and wear conditions.

In addition to providing the hard iron sulfide particles of finite size, the excess sulfur in the iron also results in excellent castability and freedom from surface and internal shrink cracks; these are characteristic defects in iron castings produced from metal of the low carbon and silicon content falling within the range of this invention, but not containing the excess sulfur content.

I claim:

1. The method of producing a wear and abrasion resistant iron casting which comprises, melting an iron alloy consisting essentially of 2.5 to 3.10% carbon, 1.40 to 2.00% silicon, manganese, sulfur in an amount equal to about 0.02 to 0.4% in excess of that required to combine with all the manganese in the alloy and the balance iron, the carbon and silicon contents being selected to produce a carbon equivalent of 3.00 to 3.60%, the carbon equivalent being between 3.00 and 3.30 when the sulfur in excess of that required to combine with all the manganese is below 0.05%; casting said alloy in a sand mold to produce a white iron casting having a microstructure characterized by substantially all of the carbon being in the combined form and appearing as discrete particles of an iron sulfide-iron carbide complex in a pearlitic matrix; annealing the casting for a period of 2 to 20 hours at a temperatutre of between 1650° to 1850° F. to graphitize the iron and at least partially break down the iron sulfide-iron carbide particles; causing the iron sulfide particles so formed to grow in size by furnace cooling the casting down to a temperature of about 1500° to 1600° F. and subsequently cooling the casting to room temperature at a more rapid rate to produce a microstructure having a pearlitic or martensitic matrix containing graphite in the form of temper carbon and discrete particles of iron sulfide of generally rounded shape visible at a magnification of 100 diameters.

2. The method called for in claim 1 wherein the carbon equivalent of the alloy is above 3.30% only when the free sulfur content exceeds 0.05% and approaches 3.60% only as the free sulfur content approaches 0.40%.

3. The method called for in claim 1 wherein the time and temperature of annealing is selected to retain in the microstructure of the finished casting particles of said iron sulfide-iron carbide complex in the matrix in addition to said discrete particles of iron sulfide.

4. The method called for in claim 1 wherein said step of more rapid cooling comprises cooling the casting in air to produce a pearlitic matrix.

5. The method called for in claim 1 wherein said step of more rapid cooling comprises quenching the casting in oil to produce a martensitic matrix.

6. The method called for in claim 1 wherein the casting comprises a camshaft and said step of more rapid cooling to room temperature is controlled to produce a pearlitic matrix and thereafter the cam surface portions of the camshaft are subjected to a surface heat treatment at a temperature below the annealing temperature to produce a martensitic structure on said cam surface portions of the casting.

7. A wear and abrasion resistant heat treated iron casting consisting essentially of 2.5 to 3.10% carbon, 1.40 to 2.00% silicon, manganese, sulfur in an amount equal to about 0.02 to 0.4% in excess of that required to combine with all the manganese in the iron and the balance iron, the metal having a carbon equivalent of 3.0 to 3.60% and having a carbon equivalent of 3.00 to 3.30 when the sulfur in excess of that required to combine with all the manganese is below about 0.05%, said casting having an annealed microstructure of a pearlitic or martensitic matrix containing particles of graphite in the form of temper carbon and a dispersion of discrete particles of iron sulfide of generally rounded shape visible at a magnification of 100 diameters.

8. An iron casting as called for in claim 7 wherein there is also dispersed in said matrix particles of iron sulfide-iron carbide complex of larger size than said iron sulfide particles.

9. An iron casting as called for in claim 7 wherein the casting is a camshaft for an internal combustion engine.

10. An iron casting as called for in claim 9 wherein the cam surface portions of the camshaft have a martensitic matrix and the internal sections of the camshaft have a pearlitic matrix.

* * * * *